US006112571A

United States Patent [19]

Tung

[11] Patent Number: 6,112,571

[45] Date of Patent: Sep. 5, 2000

[54] TWO-POINT DOUBLE TOGGLE MECHANISM

[75] Inventor: Jung-Kuei Tung, Taichung Hsien, Taiwan

[73] Assignee: Ing Yu Precision Industries Co., Ltd., Taichung Hsien, Taiwan

[21] Appl. No.: 09/273,552

[22] Filed: Mar. 22, 1999

[51] Int. Cl.[7] ..... B21J 9/18

[52] U.S. Cl. ..... 72/451; 100/286

[58] Field of Search ..... 100/286, 281, 100/282; 72/450, 451

[56] References Cited

U.S. PATENT DOCUMENTS

| | | | |
|---|---|---|---|
| 2,979,975 | 4/1961 | Schloz et al. | 100/286 |
| 3,052,200 | 9/1962 | Dehn et al. | 100/286 |
| 4,318,325 | 3/1982 | Bareis et al. | 100/286 |

*Primary Examiner*—David Jones
*Attorney, Agent, or Firm*—Bacon & Thomas, PLLC

[57] ABSTRACT

A two-point double toggle mechanism, in which a motor is used to drive a flywheel and cause a crankshaft to rotate, is arranged such that the crankshaft is pivot-jointed with a connecting rod to drive two sets of double toggle mechanisms disposed symmetrically on left and right sides of the crankshaft. Each toggle mechanism includes an L-arm. One end of the L-arm is pivot-jointed to the connecting rod via a guide pin, and one of two holes formed in the L-arm accommodates an eccentric shaft. The other end of the L-arm connects a toggle strip via a post pin, and the other end of the toggle strip is pivot-jointed with a guidepost via another post pin, which connects a sliding block located thereunder. When the crankshaft rotates to drive the connecting rod, the guide pin will move up and down linearly to unify angular motion of the double toggle mechanisms and keep the sliding block constantly horizontal while it is moved vertically up and down.

1 Claim, 6 Drawing Sheets

TWO-POINT DOUBLE TOGGLE MECHANISM

BACKGROUND OF THE INVENTION

This invention relates to a punching machine, and particularly to a toggle punching machine that can keep a sliding block of the punching machine always horizontal when moving up and down.

A punching machine usually depends on rotation of a crankshaft to drive a connecting rod that causes a sliding block to move up while being kept horizontal, in order to down and punch a working piece with a die. It is preferred that the prior punching machine move at a relatively high speed when approaching a working piece in order to shorten time for doing work. However, the speed of the prior toggle punching machine is limited because it must slow its speed down when approaching a working piece causing a relatively longer time for doing work. Therefore, a two-point single toggle mechanism has been proposed as shown in FIG. 1, which is composed of a double eccentric crank shaft with a connecting rod pivot-jointed, i.e., pivotally joined, to each of two opposite positions, the other end of the connecting rods being pivot-jointed pivotally joined to a single toggle mechanism. As FIG. 1 indicates, those two connecting rods driven directly by the crank shaft cannot move linearly, so that the motion angles at the left and right side of the single toggle mechanism are not equal, causing a declined angle (θ) during movement of the sliding block under the single toggle mechanism, resulting in a degraded punching quality.

Another two-point single toggle mechanism shown in FIG. 2 is almost the same as shown in FIG. 1 except an approximate rectilinear motion mechanism is added and disposed at the joint of the toggle mechanism and the connecting rods. Though the abovesaid declined angle (θ) has been improved more or less, it still fails to hold the sliding block horizontal when moving up and down, and the drawback cannot thus be eliminated for high precision processing.

In view of above imperfection, this invention adopts a single eccentric crankshaft connected with a connecting rod and a guide pin, is pivot-jointed to one set of a double toggle mechanism on the left and right side respectively, and thereby, the sliding block can be always be held horizontal when it moves vertically.

SUMMARY OF THE INVENTION

This invention is proposed mainly to raise punching precision by adopting a single eccentric crankshaft connected with a connecting rod and a guide pin to realize a rectilinear motion of a joint between the connecting rod and an L-arm by virtue of the guide pin. The above arrangement is capable of rectifying the motion angle of one set of a double toggle mechanism to coincide with that of the other, and thereby, a sliding block can be always be held horizontal when it moves vertically.

Another object of this invention is to utilize a two-point double toggle mechanism to preclude oblique phenomenon of the sliding block when it moves up and down to prolong the lifetime of a die.

A further object of this invention is to attain an efficacy of dynamic balance due to opposite motion direction of the connecting rod to the sliding block for minimizing the machine vibration.

For achieving the above objects, the embodied skill of this invention may be summarized as the following:

This invention relates to a two-point double toggle mechanism. A motor is used to drive a flywheel and a crankshaft to rotate. The crankshaft is pivot-jointed to a connecting rod that drives two symmetrical sets of double toggle mechanisms respectively disposed on the left and right hand of the crankshaft. The double toggle mechanisms are composed of an L-arm with one end pivot-jointed to the connecting rod via a guide pin, and the L-arm is provided with two holes, wherein one hole is connected with an eccentric shaft, the other with a toggle strip through a post pin. Another end of the toggle strip is pivot-jointed to a guide post via a post pin. When the crank shaft rotates, the connecting rod is driven accordingly to manage the motion angles of the double toggle in the L-arm and the toggle strip at both sides to become unified in order to hold the sliding block always in horizontal when it moves up and down. Hence, if the present mechanism is applied to a punching or shearing processing, a high precision work piece can be obtained.

DETAILED DESCRIPTION OF THE PREFERRED EMBODIMENT

Figure 1:
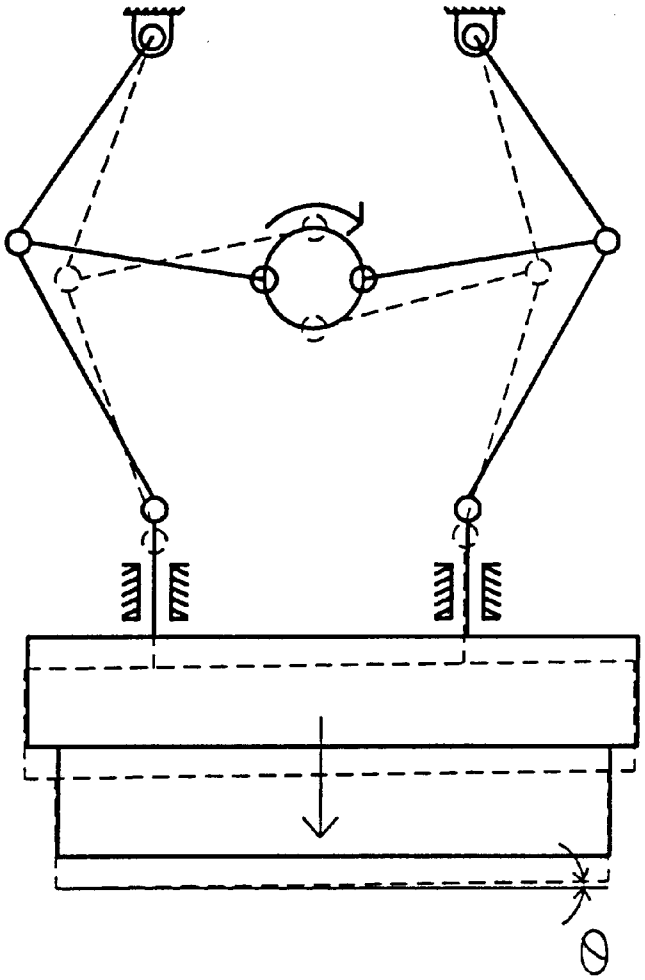
Fig. 1 PRIOR ART
FIG. 1 is a schematic structure and action diagram of a conventional two-point single toggle punching machine according to the prior art.
Figure 2:
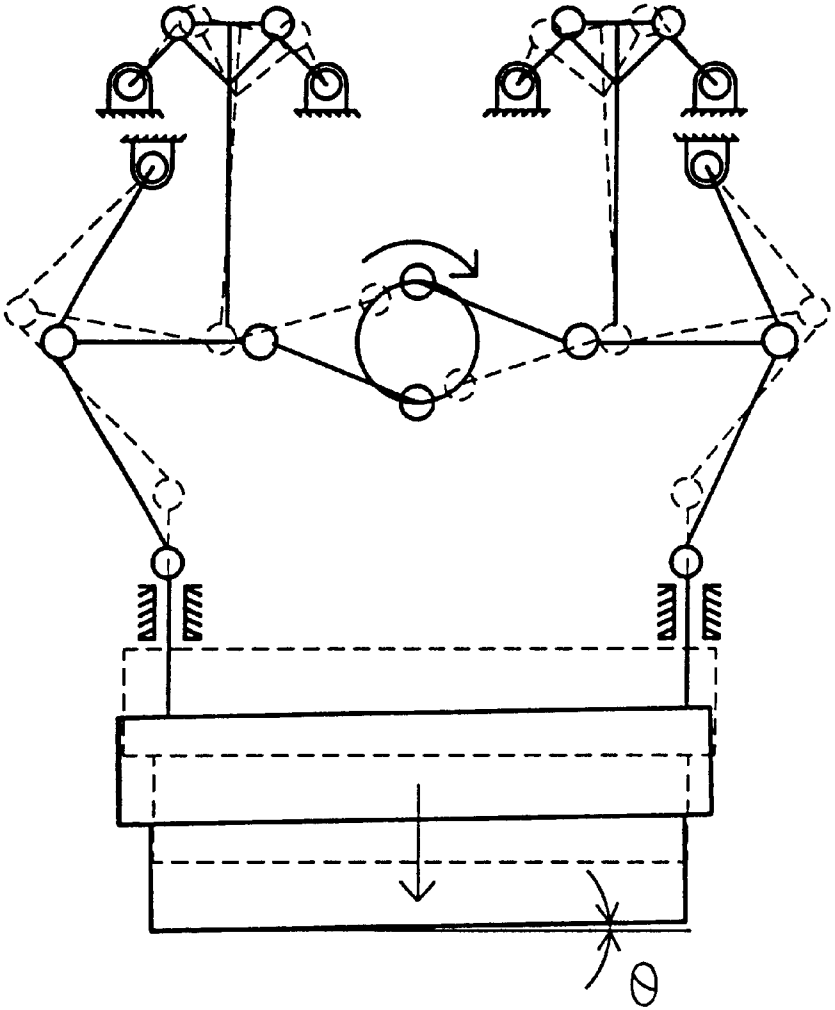
Fig. 2 PRIOR ART
FIG. 2 is a schematic structure and action diagram of another conventional two-point single toggle punching machine according to the prior art.
Figure 3:
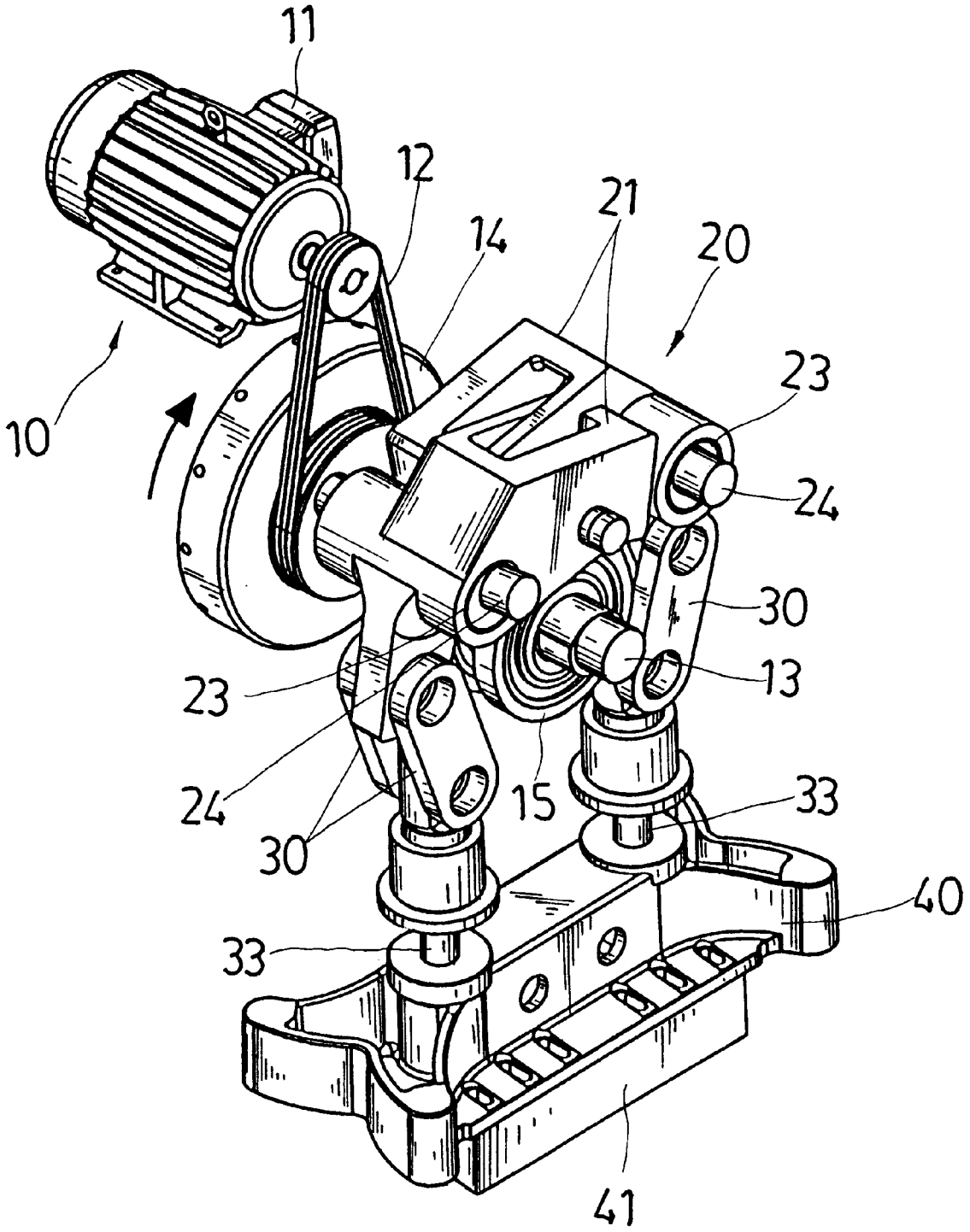
FIG. 3 is an elevational view of a preferred embodiment of this invention.
Figure 4:
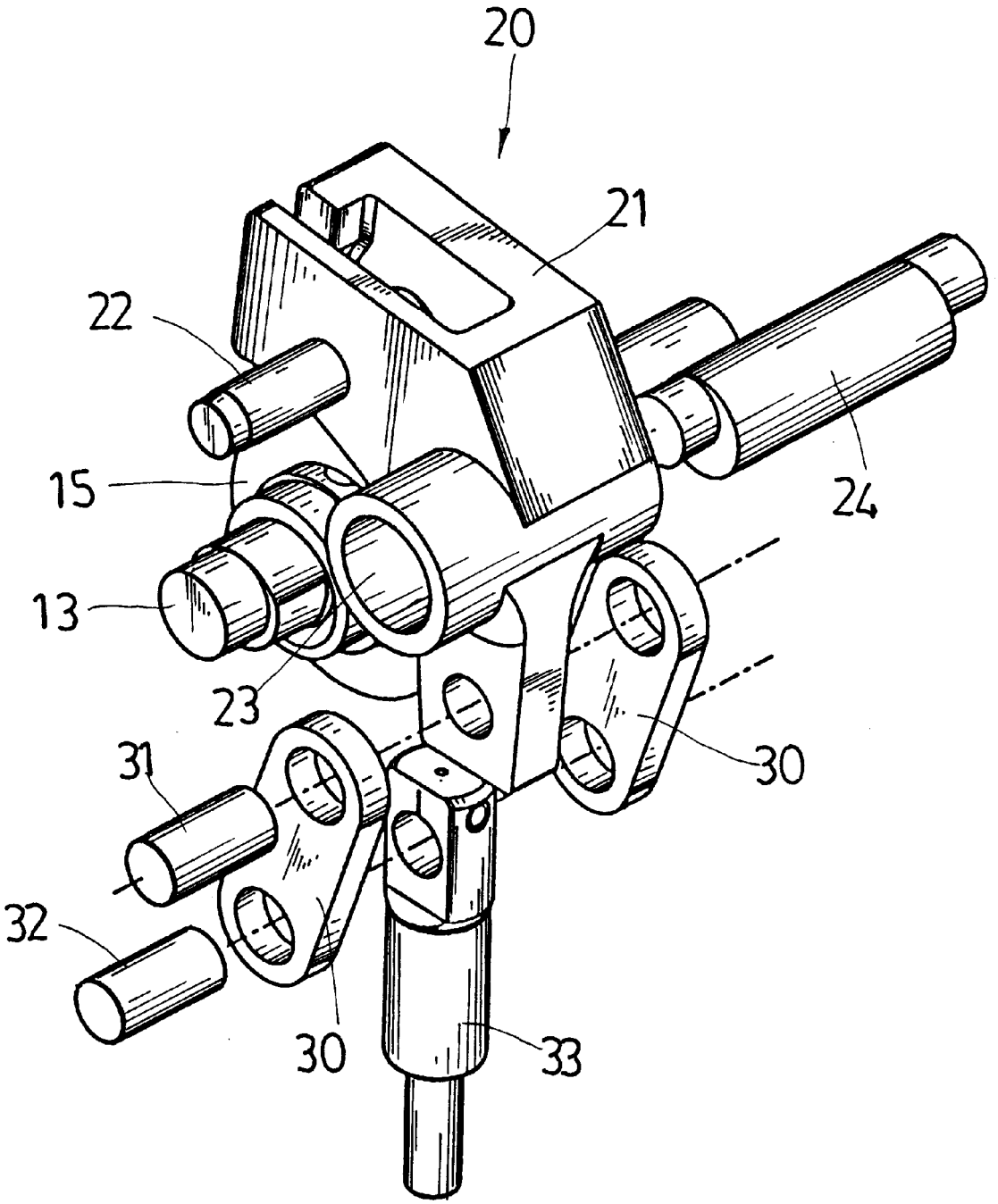
FIG. 4 is a partially exploded view of a preferred embodiment of this invention.

As shown in FIG. 3 through FIG. 6, a two-point double toggle mechanism mainly comprises a transmission set 10 and a sliding block 40. The transmission set 10 further comprises a motor 11 used to drive a crank shaft 13 and a flywheel 14 to rotate via a belt 12, wherein a connecting rod 15 is pivot-jointed to the crank shaft 13 and two sets of double toggle mechanisms 20.

Figure 5:
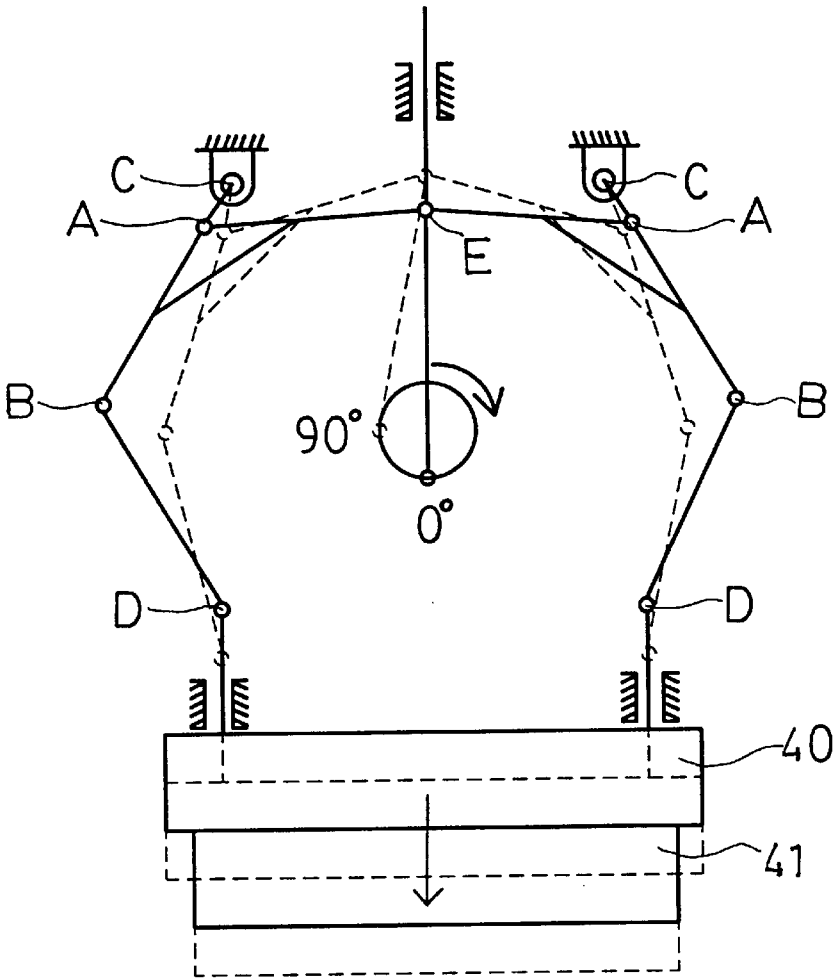
FIG. 5 is a schematic structure and action diagram of a preferred embodiment of this invention.

The double toggle mechanisms 20 are disposed symmetrically on the left and right side of a connecting rod 15, each double toggle mechanism 20 containing an L-arm 21, wherein one end of the L-arm 21 is pivot-jointed with the connecting rod 15 of the transmission set 10 via a guide pin 22 (pivot point E in FIG. 5). A pivot hole 23 (toggle point A) disposed at a corner of the L-arm 21 is pivot-jointed with an eccentric shaft 24 (toggle from C to A); and another end of the L-arm 21 is pivot-jointed with two toggle strips 30 via a first post pin 31 (toggle point B). The toggle strip 30 is pivot-jointed to a guidepost 33 (pivot point D).

The sliding block 40 disposed under those guideposts 33 is provided with an upper die 41 located thereunder (a work piece is placed on a corresponding lower die, not shown).

Figure 6:
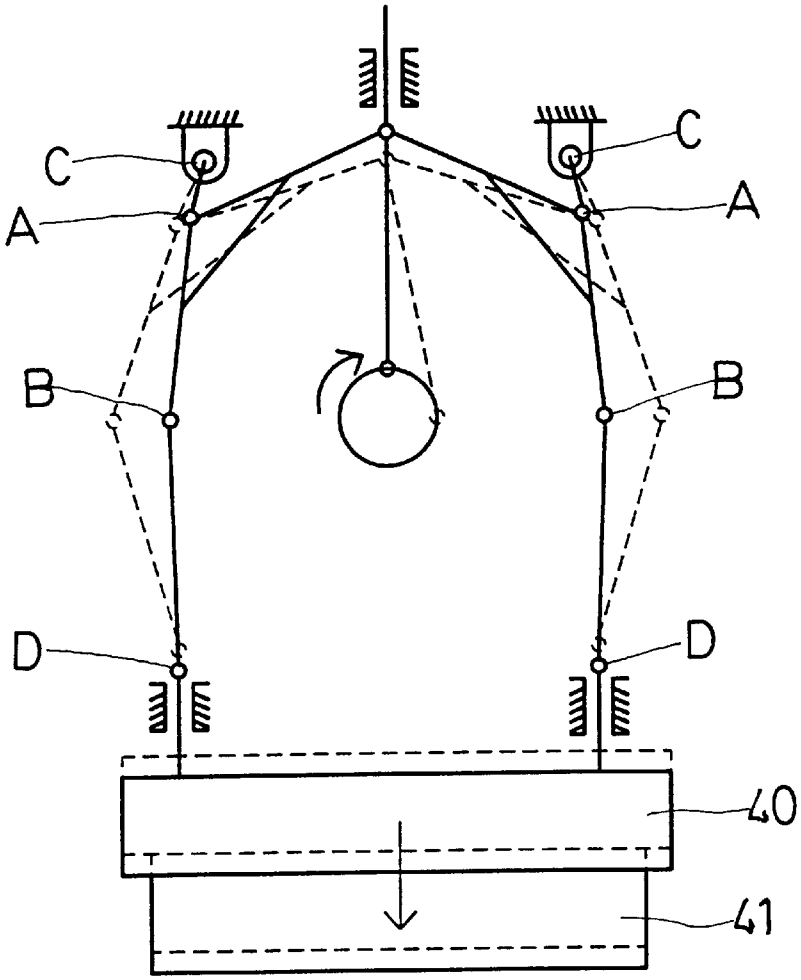
FIG. 6 is a schematic structure and action diagram of a preferred embodiment of this invention.

When the crankshaft 13 of this invention rotates 90° forward (as shown in FIG. 5), the connecting rod 15 is driven to drive the L-arm 21 to move upwards vertically (due to design of a guide track and the guide pin in linear motion, one end of the connecting rod 15 can move up and down linearly), and meanwhile, by virtue of a combination of the crank shaft 13 and the connecting rod 15 that can unify rotation angle in both sets of double toggle mechanism 20 of this invention, the sliding block 40 is kept in horizontal by the guide posts 33 to move up and down. When the crankshaft 13 rotates to 180° as shown in FIG. 6, the upper die punches a working piece. For the reason that the rotation angles can be unified as abovesaid, and the sliding block 40 and the connecting rod 15 move in opposite directions, a dynamic balance can be obtained to minimize operational vibration, so that the sliding block 40 can slide vertically without obliquity. When the crankshaft 13 reaches 270° (as show in FIG. 6), and then the origin (as shown in FIG. 5), the sliding block 40 returns to its starting point following action of the double toggle mechanism 20 to complete a working cycle. As the toggle point (A) and (B) in those two sets of double toggle mechanism 20 and the connecting rod 15 move in an opposite way to that of the sliding block 40, the latter can slide in a balanced condition without obliquity to prolong the lifetime of the die.

The merits of this invention may be summarized as:

1. Since this invention comprises only two sets of double toggle mechanism, a crank shaft, and a connecting rod, error is far less than a conventional arrangement that comprises a single toggle mechanism, a double eccentric crank and connecting rod.

2. A vertical guide track in the symmetrical two sets of double toggle mechanism is applied to guide the connecting rod linearly instead of the non-linear motion in a conventional toggle mechanism, that usually results in a degree of obliquity during movement of a sliding block.

3. As the connecting rod and the sliding block of this invention move in opposite directions, sliding block is benefited with efficacy of dynamic balance.

4. The abovesaid merits enable the sliding block to move steadily to raise quality, prolong lifetime, and reduce cost.

What is claimed is:

1. A two-point double toggle mechanism, comprising:

a transmission set including a motor arranged to drive a crank shaft and a flywheel via a belt, wherein said crank shaft is pivotally joined to a connecting rod and said connecting rod is further pivotally joined to two double toggle mechanisms disposed symmetrically at opposite sides of said connecting rod; each said double toggle mechanism comprising:

an L-arm pivotally joined at a first end to said transmission set via a guide pin, and a pivot hole disposed at a corner of said L-arm to form a toggle point, said pivot hole being arranged to accommodate an eccentric shaft, wherein a second end of said L-arm pivot-jointed to a first end of a toggle strip via a first post pin to form another toggle point, the second end of each said toggle strip being pivotally joined to a respective one of a pair of guide posts via a second post pin; and a sliding block located under said guide posts, said sliding block having an upper die laid thereunder;

wherein said crank shaft is arranged to rotate and drive said connecting rod to enable one end of each said L-arm to move up and down linearly, such that when two toggle points and said toggle strips move in angular motion, the angular motion of the two toggle points and toggle strips is unified by linear motion of the guide pin, so that the guide posts hold said sliding block constantly horizontal when the sliding block moves up and down.

* * * * *